United States Patent [19]

Pitcher et al.

[11] 4,456,323

[45] Jun. 26, 1984

[54] CONNECTOR FOR COAXIAL CABLES

[75] Inventors: William E. Pitcher, Bridgewater, Conn.; Peter W. Baione, East Meadow; John A. Morelli, Coram, both of N.Y.

[73] Assignee: Automatic Connector, Inc., Commack, N.Y.

[21] Appl. No.: 319,788

[22] Filed: Nov. 9, 1981

[51] Int. Cl.[3] ..... H01R 17/18

[52] U.S. Cl. ..... 339/177 R; 339/217 R

[58] Field of Search ..... 339/177 R, 177 E, 89 C, 339/90 C

[56] References Cited

U.S. PATENT DOCUMENTS

| | | | |
|---|---|---|---|
| 3,644,874 | 2/1972 | Hutter | 339/177 E |
| 3,744,011 | 7/1973 | Blanchenot | 339/177 R |
| 3,778,535 | 12/1973 | Forney | 339/177 R |
| 4,053,200 | 10/1977 | Pugner | 339/177 R |
| 4,093,335 | 6/1978 | Schwartz et al. | 339/177 E |

FOREIGN PATENT DOCUMENTS

| | | | |
|---|---|---|---|
| 2727591 | 1/1978 | Fed. Rep. of Germany | 339/177 R |

*Primary Examiner*—Eugene F. Desmond
*Assistant Examiner*—David L. Pirlot
*Attorney, Agent, or Firm*—Peter L. Berger

[57] ABSTRACT

A connector for coaxial cables is disclosed in which the sub-assemblies are changed. Reduction in numerous machining operations required to form the elements of the sub-combinations have resulted in a less expensive connector which may be assembled automatically.

5 Claims, 7 Drawing Figures

CONNECTOR FOR COAXIAL CABLES

BACKGROUND OF THE INVENTION

This invention relates to an improved connector for coaxial cables.

Coaxial cable connectors are generally made of metal components. These are either metal components which are formed or drawn or metal components worked on screw machines. Generally, it is considered that screw machine parts which are used as components for such connectors exhibit improved structural and electrical characteristics, and these components are generally preferred by cable manufacturers when using connectors for coaxial cables.

A popular coaxial cable connector is that identified as the Wedgelock which is manufactured by the assignee of the present invention. This Wedgelock connector exhibits excellent structural and electrical characteristics and has been widely used throughout the industry for many years. Unfortunately, the cost of manufacture of this type connector is relatively high, since numerous machining steps are required to fabricate such a connector. Further, labor time employed in assembling such a connector is also extensive, and this type connector, although possessing excellent electrical characteristics, is expensive.

Coaxial connectors which are assembled in the field present some difficulties. In particular, it is necessary to effect electrical soldering in the field, and this can be problematic.

Consequently, an object of this invention is to provide an improved coaxial cable connector exhibiting significant economies in terms of the components, machine time used to fabricate the components and assembly time to assemble the coaxial connector.

Another object is to achieve such characteristics without degrading the electrical and structural characteristics found in this type connector.

Still another object of this invention is to provide a connector which is field serviceable, eliminating the need for soldering when the cable connector is assembled.

Other objects, advantages and features of this invention will become more apparent from the following description.

SUMMARY OF THE INVENTION

In accordance with the principles of this invention, the above objects are accomplished by providing a coaxial cable connector in which a wedge is employed as the connector is assembled. The wedge helps effect proper electrical connection between the coaxial cable and the outer and center contacts. The connector comprises machined parts which are capable of being quickly fabricated and effectively assembled. Automation techniques may be employed in the assembly of such connectors. Additionally, a field serviceable connector is provided which eliminates the need for making solder joints in the field.

DETAILED DESCRIPTION

Figure 1:
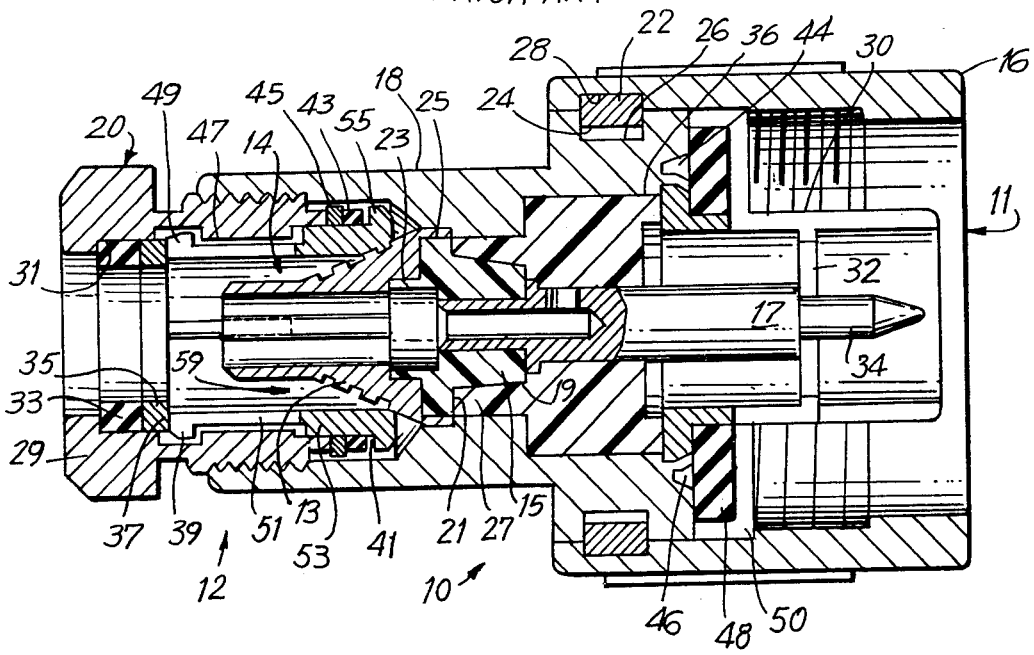
FIG. 1 PRIOR ART
FIG. 1 is a sectional view of a prior art connector assembly.

FIG. 1 is a sectional view of the Wedgelock connector assembly 10 which is the prior art and is the subject of U.S. Pat. No. 3,107,135. Generally, the connector is formed of three primary sub-assemblies, these being identified as the plug sub-assembly 11, the wedge-nut sub-assembly 12, and the center contact sub-assembly 14. Generally, the connector includes a front coupling nut 16 which is coupled to body 18, and the entire assembly is generally assembled together through the operation of wedge-nut 20.

The coupling nut is physically structurally held and connected to body 18 by means of a C-ring 22. The C-ring 22 fits into a counterbore 24 formed by opposite recesses 26 and 28 in the body and the coupling nut, respectively. The C-ring holds the body and coupling nut together, permitting relative rotation between the coupling nut and the body.

The connector plug sub-assembly 11 includes outer contact 30 having a shoulder 32 formed between the contact for purposes of accommodating to connector mismatch when the female connector is put into the male connector as represented by center contact 34. Additionally, the prior art connector plug assembly includes an insulator or dielectric 36 which has a counterbore 38 formed in the front surface as well as two counterbores 40 and 42 formed in the rear surface. The counterbores 40 and 42 hold the insulator in place, while the front counterbore 38 is used for electrical matching. The outer contact 30 is connected to body 18 in a V groove 44 which is machined into the front surface of the body. The outer contact 16 has a small angle 46 formed at the rear thereof which fits behind the V-groove 44 of the body, and when the outer contact is placed against the body the V-groove is swaged to capture the outer contact against the body. Further, an annular gasket 48 is captured between an outer flange 50 of the outer contact 16 and the body to provide moisture proofing.

In order to facilitate understanding the invention, each sub-assembly of the present invention will be separately presented.

Figure 2:
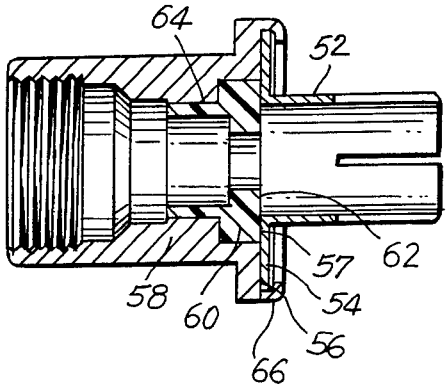
FIG. 2 is a sectional view of the plug sub-assembly of this invention.

FIG. 2 is a sectional view of the connector plug sub-assembly of this invention. The sub-assembly includes a hat shaped outer contact 52 without the shoulder 32 of the prior art. The outer contact 52 terminates in a flange 54 which bears against front portions 56 and 57 of body 58 and an insulator 60. Insulator 60 has a flat front surface 62 without a counterbore such as 38 in the prior art. Further insulator 60 only has a single counterbore 64 in the rear portion thereof. The machining steps necessary to form insulator 60 as contrasted with those necessary to form insulator 36 of the prior art reveals significant simplification.

The body 58 further comprises an outer rim portion 66 which is bent or spun over to capture the flange 54 of the hat at that spinover point. This eliminates the C-ring 22 as well as the recesses which were required to be machined into the body 18 and the coupling nut 16 of the prior art. This significantly eliminates machining time as well as skilled labor operations which improves the overall economy of the present invention.

Shoulder 40 of the prior art insulator 36 is also eliminated, and that shoulder was for purposes of holding the insulator against the center contact. This is now accomplished by a fishtail which will be described in a later sub-assembly drawing, the fishtail holding the insulator 60 and center contact together preventing axial movement between those two parts.

Figure 3:
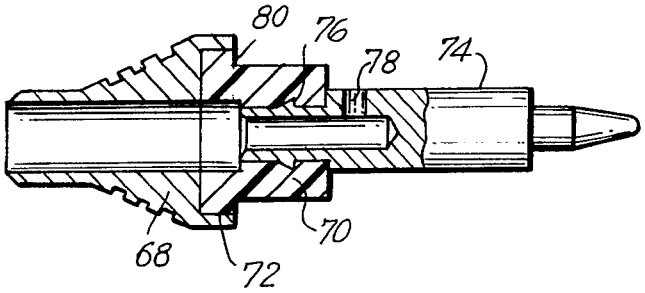
FIG. 3 is a sectional view of the contact wedge sub-assembly of this invention.

FIG. 3 is a sectional view of the contact-wedge sub-assembly which comprises three main parts, one being a wedge 68 which is substantially similar to the prior art wedge 13, an insulator 70 which is adapted to be press fit into a seating surface 72 formed in the wedge and a center contact 74.

The same type parts form the main components of the prior art contact-wedge sub-assembly of FIG. 1. In particular, this sub-assembly includes the wedge 13, an insulator 15 and center contact 17. The prior art insulator 15 is provided with a tapered front surface 19, a counterbore 21 in the front portion and a counterbore 23 in the rear portion thereof. Counterbore 23 cooperates with a front step 25 in wedge 13 and counterbore 21 bears against rear abutting portion 27 of insulator 36 to prevent axial movement.

The center contact of the present invention (FIG. 3) includes an annular hook 76 which grabs insulator 70 preventing axial movement between the insulator and center contact. Conventionally, a solder hole 78 is provided in center contact 74 to secure the center conductor of the cable into the center contact 74 and to provide electrical connection between the center contact and center conductor of the cable. The present invention provides an improved construction in that a simple counterbore is formed at 80 where it is pressfit into seating surface 72. That counterbore is much simpler to machine than the two stepped counterbores required for the prior wedge. This reduces machining operations, eliminates labor required for such machining and also improves the economy of the present connector.

The prior art connector (FIG. 1) includes a wedge-nut ferrule sub-assembly 20 including a wedge-nut 29 having a hex-head nut and an inner recess 31 formed in said wedge-nut holding a gasket 33 and a washer 35 which bears against the rear of a ferrule 39. The front portion of the ferrule 39 includes a recess 41 in which a gasket 43 and a washer 45 are located. The wedge-nut 29 includes the previously identified hex-nut and a front extension which bears against the ferrule 39. Additionally, the wedge-nut includes an inwardly projecting annular shoulder 47 projecting inwardly from the inner surface of the nut. The ferrule 39 includes a rear outward annular lip 47 and an intermediate slotted section 51 which is integral with the front portion 51 of the ferrule 39. The front portion bears against the wedge 13 and terminates in outer annular ridge 55. Ridge 55 services to capture gasket 43 and washer 45 between the ferrule and wedge-nut 29 and to help form recess 41.

The gaskets and washers were provided to prevent moisture from entering the connector, and expensive machining time was required to form the above-identified counterbores holding these components. Additionally, the ferrule 29 is held within the nut by the shoulder 47 which required yet additional machining operations.

One of the important advantages of the prior connector over other prior art connectors was that the center cable was free to rotate with respect to the wedge-nut and ferrule as the connector was being assembled. When fully assembled, the cable is fixedly held within the ferrule and wedge-nut assembly, but while the wedge-nut 29 is being rotated into the body 18, rotation of the cable prevents its tearing. This is accomplished by means of the wedge 13. Its tapered surface 59 and gripping teeth 61 progressively grip the outer braid of the cable between the ferrule and the wedge. In assembling the prior wedge-nut sub-assembly, the ferrule is inserted within the nut by bending the ferrule at the slots in the intermediate section to permit it to pass beneath shoulder 47, and as it passes the shoulder it snaps in place against the shoulder. The machining operations to form the slots and shoulder are complicated, time consuming, expensive and undesirable.

Figure 4:
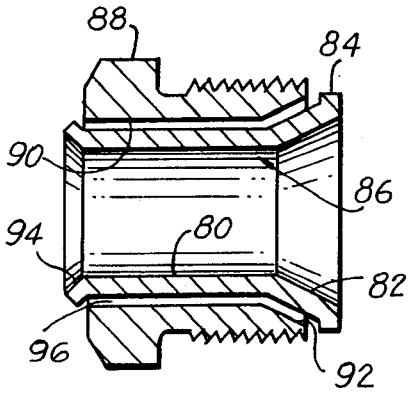
FIG. 4 is a sectional view of the wedge-nut female sub-assembly of this invention.

FIG. 4 is a sectional view of wedge-nut ferrule sub-assembly of this invention. This wedge-nut sub-assembly comprises a straight line cylindrical member 80 for the ferrule having an outward taper 82 at the front end terminating in a shoulder 84, the shoulder 84 providing a positive hold between the ferrule 86 and the wedge-nut 88 of this invention. The wedge-nut also is simply formed having a complementary inner straight cylindrical section 90 and a forward taper 92 complementary to taper 82 of the ferrule. The rear end, of the ferrule terminates in an outward flare 94 which serves two purposes. One is to reduce friction and to eliminate the sharp point where the coaxial cable is inserted into the ferrule and the second is to hold the wedge-nut 88 in place with respect to the ferrule 86. Sufficient space 96 is provided in the frontward flared sections between the ferrule and the nut to permit rotation therebetween as the connector is being assembled. The wedge-nut 88 can rotate with respect to the ferrule as the wedge-nut 90 is being screwed into the body 58 (see FIG. 2) to join the connector-cable combination together. The present wedge-nut ferrule sub-assembly eliminates the need for the extensive gasketing at the rear of the sub-assembly as found with gasket 33. This has been attained by providing the narrow annular space 96 in which a metal to metal joint forms when the connector is assembled. A type of cold bond is formed in the space which prevents moisture from entering into the connector degrading its performance.

The present wedge-nut ferrule sub-assembly presents numerous advantages over the prior art. The gasket 33 and washer 35 have been eliminated, the machining operations required for accommodating those elements have been eliminated, the slotted nature of the ferrule has been eliminated, most of the machining operations employed for the ferrule have been eliminated and this has been accomplished without deteriorating electrical or mechanical characteristics of the wedge-nut ferrule sub-assembly or the combined connector.

Figure 5:
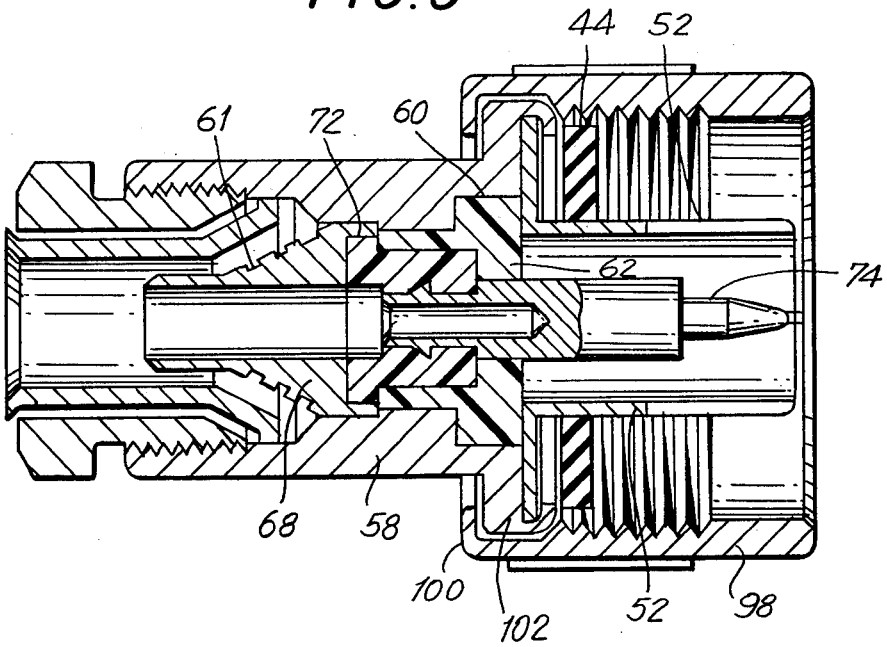
FIG. 5 is a sectional view of the connector assembly of this invention.

The three parts forming the invention are shown together in FIG. 5 which is a cross-sectional view of the assembly. A coupling nut 98 is provided with a spinover 100 in the rear portion thereof which allows the coupling nut to be connected to the body 58 while allowing relative rotation between those two elements as the coupling nut is rotated. The coupling nut 98 prior to being assembled in the connector has its rear cylindrical section bent or spun over a forward outer flange 102 of body 58 which captures the body in the spinover 100. This arrangement is significantly improved over the C-ring 22 used in the prior art to achieve the coupling of the nut and body while permitting their rotation. The machining operations required for providing the counterbores and recesses necessary to accommodate the C-ring and its associated elements have been eliminated. Overall, a visual comparison of the prior art connector of FIG. 1 and that of the present invention in FIG. 5 reveals the major improvements.

In addition to the observable differences between the prior art connector and that of the present invention, there are other important advantages. Although significant economies are realized with the new connector design, other economies are important as well. These economies relate to the ability to automate the assembly of the sub-assembly components because of the simplified connector design. Since automation is important in reducing labor costs, the connector of this invention will be significantly less expensive to manufacture.

Figure 6A:
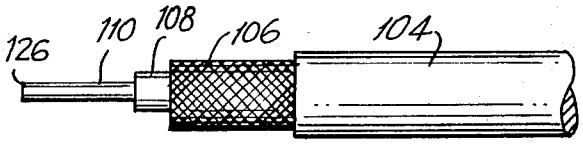
FIG. 6*a* is a pictorial view of a coaxial cable stripped for connection in the field serviceable unit of FIG. 6.
Figure 6:
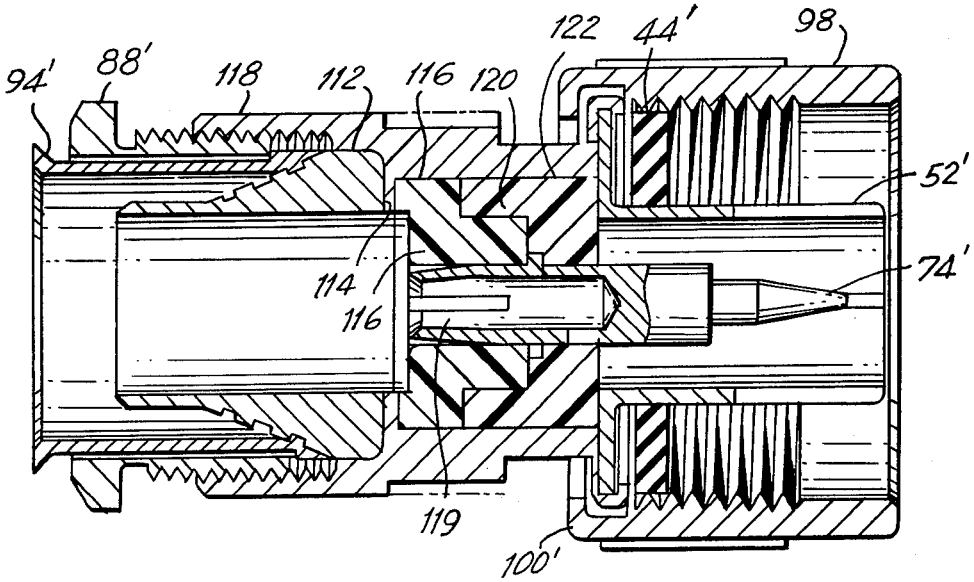
FIG. 6 is a sectional view of another embodiment of this invention illustrating a field serviceable connector.

FIG. 6 is a cross-sectional view of another embodiment of the invention. Similar numerals will be used where appropriate. This embodiment is directed to a field serviceable connector in which there is no soldering required. In the prior art, soldering as at 78 (see FIG. 3) mechanically and electrically joins the center conductor which either may be solid or stranted to the center contact.

FIG. 6*a* illustrates a stripped coaxial cable used with the field serviceable connector of FIG. 6. The cable has an outer jacket 104 which is stripped to expose a braided outer conductor 106 which itself is stripped to expose a central insulator 108 which separates outer conductor 110 from braided conductor 106. The central insulator 108 is stripped to expose a length of the center conductor 110.

The wedge 112 of FIG. 6 is provided with a flat front face 114 which eliminates the front seat 72 formed in the wedge of FIG. 5. This reduces further machining operations. Insulator 116 is extended less deeply rearwardly than is insulator 70 of FIG. 5. The body 118 is counterbored at 120 to seat insulator 116 and bear against wedge 112. Center contact 74' terminates in tines 119, the tines being compressible to capture the center conduit 110 therein, as will be explained more hereinafter. Insulator 116 bears against insulator 120 which is formed with a straight cylindrical outer edge 122 which contrasts with counterbore 124 formed in insulator 62. This field serviceable unit of FIG. 6 operates as follows: the cable will be stripped as shown in FIG. 6*a;* the center conductor 110 will be tapered at its front end 126 to facilitate the entry of the stripped cable into the tined receptacle position 119 of the center contact. The stripped cable will be held vertically and the wedge-nut 88' will be dropped thereon after the wedge-nut sub-assembly is assemblied. Next the wedge 112 will be dropped onto the cable, and the cable is shoved with its exposed center conductor 110 into the tined center conductor 119. This friction fit between the exposed center conductor will hold the cable within the center contact while the wedge-nut is brought up and screwed into the body 118. No solder is required, and the electrical and mechanical connection between center conductor of the coaxial cable is maintained because of the friction fit between the intes and the center conductor itself.

Although this invention has been described with reference to the disclosed embodiments, other modifications may be made by those of skill in the art which will fall within the scope of the claimed invention.

What is claimed is:

1. A coaxial cable connector having a wedge for receiving and securing said coaxial cable in said connector, said coaxial cable having an inner conductor, an insulator surrounding said inner conductor and an outer conductor surrounding said insulator, said connector comprising a wedge-nut sub-assembly, said wedge-nut sub-assembly comprising a wedge-nut and an inner ferrule, said wedge-nut having a substantially straight inner cylindrical aperture terminating in an outward forward flare, said ferrule having a shape complementary to the inner aperture of said wedge-nut, said ferrule terminating in an outward flare at its front which faces the outward forward flare of said wedge-nut, said ferrule and said wedge-nut separated by an annular space permitting rotation of said ferrule with respect to said wedge-nut, said outward flare of said ferrule adapted to press the outer conductor of said coaxial cable against said wedge, said connector further comprising a plug sub-assembly comprising a body adapted to be threaded onto said wedge-nut, said connector being assembled as said body and wedge-nut are drawn together pressing said outer conductor against said wedge by said ferrule as said wedge-nut is rotated in said body, said ferrule expanding into said annular space to bear against said wedge nut when said connector is assembled to provide a barrier to moisture entering said connector from the rear of said wedge-nut sub-assembly, wherein the body of said plug sub-assembly terminates in a forward shoulder, a connector nut rotatably connected to said body by spinning a rear portion thereof over said forward shoulder to rotatably capture said body, wherein said plug sub-assembly comprises an outer contact having a rear flange, said body being connected to said outer contact by spinning a front flange portion over said rear flange to capture said outer contact.

2. A coaxial cable connector as claimed in claim 1, wherein said contact wedge sub-assembly comprises said wedge having a forward counterbore forming a seating surface, an insulator having a shoulder portion inserted in said seating surface and a stepped down forward cylindrical section, and a center contact having a hook for fixedly holding said center contact in said insulator of said contact wedge sub-assembly.

3. A coaxial cable connector as claimed in claim 1, wherein said connector comprises a center contact for receiving the center conductor of said coaxial cable, said center contact comprising a tined receptacle which is crimped onto said center conductor providing a field serviceable connector assembleable without solder.

4. A plug sub-assembly for a coaxial cable connector formed of screw machine parts, the plug sub-assembly comprising a body having a stepped opening therethrough terminating in a flat front surface, a front counterbore formed in said flat front surface forming a front cavity, a one-piece insulator seated in the cavity, the one-piece insulator having a front flat surface with a central aperture therethrough enabling a center contact of said connector to pass therethrough, an outer contact electrically coupled and fixedly connected to the body, the outer contact having a flat rear flange bearing against the flat front surfae of the body and the flat front surface of the insulator, the body comprising a forwardly disposed flange spun over the flat rear flange of said outer contact to capture the flange and outer contact.

5. A plug sub-assembly for a coaxial cable connector as claimed in claim 4, wherein said outer contact comprises a hat shape.

* * * * *